United States Patent [19]

Frymire

[11] Patent Number: 4,968,030

[45] Date of Patent: Nov. 6, 1990

[54] ELECTRONIC CRIBBAGE BOARD AND GAME SCORING DEVICE

[76] Inventor: Lewis Frymire, Rte. 1, Box 127, Oneida, Ill. 61467

[21] Appl. No.: 366,691

[22] Filed: Jun. 15, 1989

[51] Int. Cl.[5] ..... A63B 71/00

[52] U.S. Cl. ..... 273/1 ES; 273/148 R; 364/411; 340/323 R

[58] Field of Search ..... 273/148 R, 1 ES, 138 A, 273/1 E; 340/323 R; 364/411

[56] References Cited

U.S. PATENT DOCUMENTS

| | | | |
|---|---|---|---|
| 4,052,073 | 10/1977 | Miller | 273/148 R |
| 4,130,871 | 12/1978 | Olson et al. | 364/411 |
| 4,193,600 | 3/1980 | Armstrong | 273/1 ES |
| 4,245,216 | 1/1981 | Rintoul | 340/323 |
| 4,286,323 | 8/1981 | Meday | 364/411 |
| 4,368,516 | 1/1983 | Morin | 364/411 |

FOREIGN PATENT DOCUMENTS

| | | | |
|---|---|---|---|
| 1195001 | 10/1985 | Canada | 273/148 R |
| 2173406 | 10/1986 | United Kingdom | 273/148 R |
| 8101766 | 6/1981 | World Int. Prop. O. | 273/1 ES |

*Primary Examiner*—Edward M. Coven
*Assistant Examiner*—Dean Small
*Attorney, Agent, or Firm*—R. A. Blackstone, Jr.

[57] ABSTRACT

An electronic card game scoring device which is used to eliminate tedious and error-prone mental calculations in scoring and recording games which provides graphic representations of symbols and characters pertinent to the type, status, and score of the game in play. The device provides pushbutton data input which allows a user to enter data into the control portion which processes the inputed data and transmits the output to data output devices such as liquid crystal displays (LCD's). The device also allows deletion of erroneously entered scores and the subsequent entering of data representing the correct score. An integral tone generator creates one of a plurality of predetermined tones or chords as determined by the control portion responsive to the type, status, and score of the game being played.

7 Claims, 3 Drawing Sheets

ELECTRONIC CRIBBAGE BOARD AND GAME SCORING DEVICE

BACKGROUND OF THE INVENTION

This invention relates to an electronic card game scoring device which is used to eliminate tedious and error-prone mental calculation in scoring and recording card games.

Many multiple player card games involve complex rules and detailed scoring procedures. A list of such games includes: cribbage, gin rummy, hearts, partnership pinochle, bridge and contract bridge. An example of the complexity of the scoring involved in such card games can be found in the game of cribbage where a player has points added or subtracted from his score depending on the hand or depending on various instances of game conduct or misconduct such as misdealing.

The following is a partial list of rules for scoring during the hand play or "pegging" portion of the game of cribbage. The "count" portion of each hand follows hand play, and employs basically the same rules:

−2 points for various misdealing penalties,

+2 points to the dealer for His Heals (jack appearing as the starter card), this must be scored before the dealer plays a card, +1 for the player whose latest play makes the sum of cards played thus far less than 31 while opponent is unable to play any card that when added to previously played cards does not exceed 31 during a game, +2 for the player who scores exactly 31 within a game, +3 if the last card added to the previously played cards to equal 15 is the last card in either player's hand, +2 if the card played makes the sum of the cards played to that period in time equal to 15, +2 if a cards is played by a player that matches or pairs the denomination of opponent's last played card, +6 for triplets or pairs royal, the triplets can be made by another player which plays his card of the same denomination on a pair of cards which resulted from opponent's latest play, +12 for playing a card which results in four of a kind, double pairs or double pairs royal, each card having been played consecutively by both players in their respective turns, +3 for a sequence or run even if the sequence or run is not played in numerical sequence such that the three cards played in sequence can be arranged so that they are a run and in this case +1 point for each additional sequential card which is played either by the same player or his opponent.

This brief list does not include such scoring rules as "Muggins" where a player, who neglects to score the full value of his hand, loses the points he should have properly scored to the player who identifies the error various permutations of the list noted above. Not to mention the impossible hands of 19, 25, 26 or 27. Additionally, cribbage is a very fast-paced game such that it is usually played by two players having 4 cards per hand completing an entire game in as few as 3–4 hands.

Over time each multiple player card game has developed a scoring sheet and/or a game board which helps to reduce confusion and the possibility of errors in game scoring and recording. For example, in the game of cribbage, mental calculations are required in order to determine a player's scores throughout the game. These scores in turn are recorded on what is commonly known as a cribbage board. Cribbage boards are typically mechanical "pull-up" boards designed with multiple tracks or lanes whereby each player is allocated a single or group of lanes. These lanes are a series of holes in the cribbage board surface into which pegs are inserted as a method of recording a player's score. By inserting pegs into the holes in the lanes, the player does not have to mentally retain his game score, and each player can easily visually evaluate his game position relative to his opponent by a brief glance at the game board and the peg positions thereon.

Typically a cribbage board provides 60 holes per player plus a start and finish hole for each. While a full length game requires 121 points to win, alternative games of cribbage require only 61 holes and therefore cribbage boards have been designed with 60 holes and a marker which indicates that a player, involved in a 121 point game, is on his second trip around his 60 hole scoring lane.

Due to the scoring characteristics of the card games mentioned above, each game may have scores which are invalid. If an invalid score is included in a player's game scoring much confusion and error is likely to arise. For example, in cribbage the scores of 19, 25, 26, 27 and greater than 29 are invalid scores and as such should never be included in a player's game score. However, under the mentally rigorous exercises of strategizing and restrategizing throughout a card game, the tedious scoring calculations during and after the game are prone to error such as incorrect addition or subtraction of numbers and transposition of numbers.

Additionally, many of these games have traditional penalties for extremely low scores or for losing by certain margins. A good illustration of this is found in cribbage, whereby when a player loses by more than 31 points but less than 61 points, he is termed "skunked". This penalty is progressively tallied, based upon the extent of the player's loss. For example, when a player loses by more than 61 but less than 91 points, he is termed "double skunked", and further, a player is "triple skunked" when he loses by more than 91 but less than 121 points.

As many of the above-mentioned card games have been developed over a long period of time, their traditions have become an integral part of the game play as well as a reward of the game play. Cribbage boards have been developed over a long period of time and as such, the traditional cribbage board layout provides for rapid indoctrination of new players by experienced players. Further, as in the case of "skunking", the penalties of these games have become engrained in the experienced players and will continue to be a traditional part of the game.

In order to reduce the possibility of error and ease the scoring of the game, many advancements have been made to improve card game scoring devices. Such an improvement was advanced by the electronic scoring device of Meday U.S. Pat. No. 4,286,323. Generally, Meday shows a device which is particularly well suited to bridge, providing score entering means and display means. However, this device merely eliminates the need for mental or pencil and paper calculations, by providing electronically recorded and displayed game scores.

A scoring device shown by Rintoul, U.S. Pat. No. 4,245,216, provides an electronic cribbage board with a common hand count display and a selected entry to respective sets of game score indicators. This device provides the advantage over Meday in that it also provides an electronic version of the traditional cribbage board layout whereby the pegs in the cribbage board lanes are lights which are automatically advanced with respect to the score which is entered and maintained in the electronic scoring portion of the device.

While both of these devices minimize the need for tedious mental calculations, a problem with these devices is that they do not provide for selective rejection of inappropriate scores or correction of scores entered erroneously. Another problem with the prior art is that there is no provision for recording or presentation of traditional game penalties. Further, while Rintoul provides for a traditional game board representation, it does not provide for such penalties as single, double, or triple skunking.

OBJECTS AND SUMMARY OF THE INVENTION

It is an object of the present invention to provide a new electronic cribbage board which provides a player with a familiar traditional cribbage board layout which does not require the player to manually advance pegs throughout the game play while avoiding any breach of integrity to the game of cribbage.

Another object of this invention is to provide an electronic cribbage board which eliminates the need for tedious manual scoring calculations, and records the scoring calculations throughout a game or a series of games.

It is a more specific object of this invention to provide an electronic cribbage board which selectively rejects inappropriate scores and allows correction of scores entered in error.

It is yet a further object of this invention to provide graphic presentation means responsive to game pertinent data for displaying representational graphic images of symbols and characters which correspond to the type, status and score of the game being played.

In accordance with the foregoing, the present invention comprises an electronic cribbage board and game scoring device which is used to eliminate tedious and error-prone mental calculations in scoring and recording games, and to provide graphic representations of symbols and characters pertinent to the type, status, and score of the cribbage game in play.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
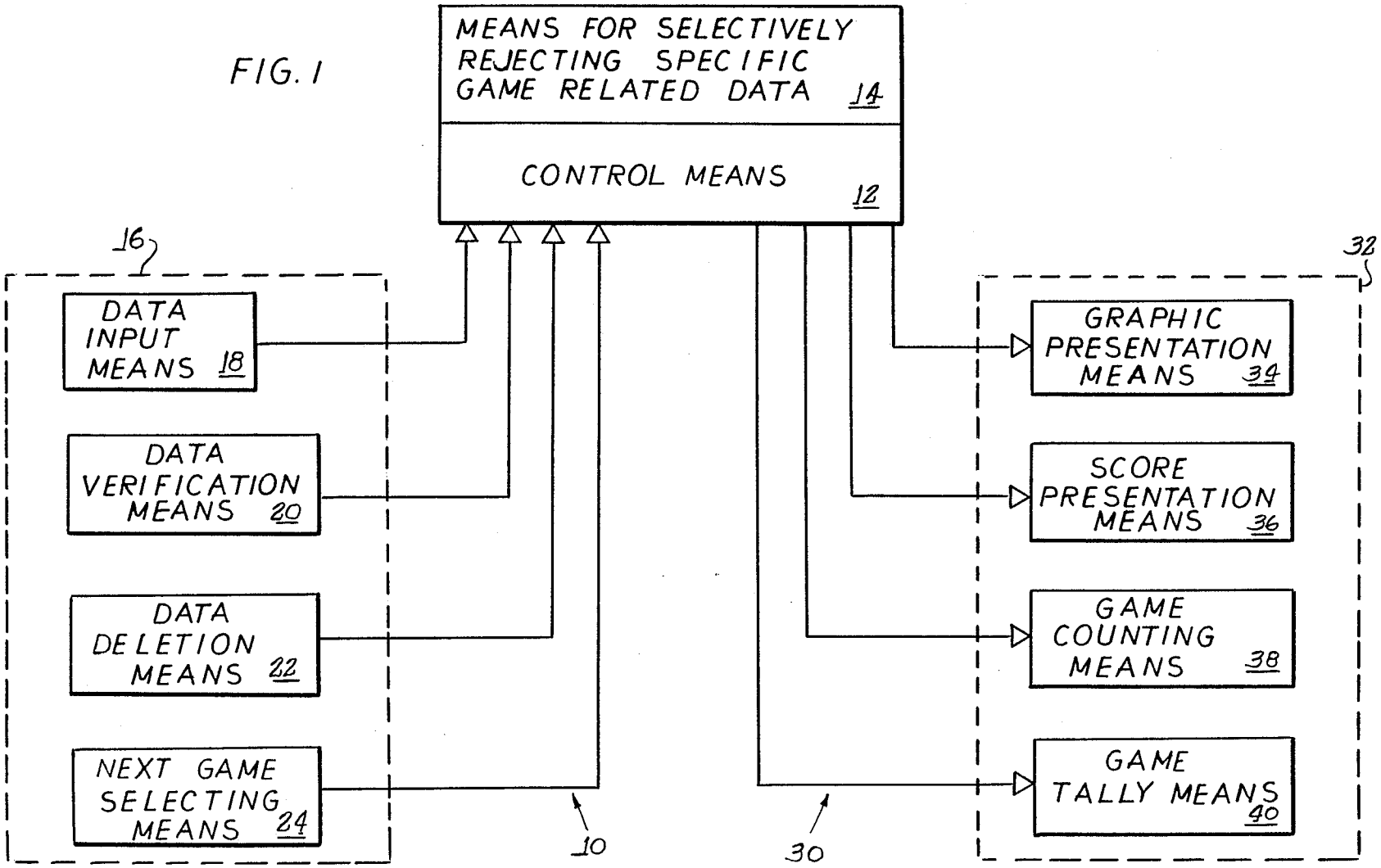
FIG. 1 is a block diagram of the present invention showing various input and output means and data paths between the input and output means and control means.

As shown in FIG. 1, the block diagram shows the data paths 10 and the interaction between the various blocks of the diagram. Shown at the center of the diagram, a control means 12 receives, processes and transmits data pertaining to a cribbage game which is being played. Data is received from the various data input means or is transmitted to the various display means. In the illustrated embodiment the control means 12 is a 8749 type microprocessor manufactured by Intel or others. Included in the control means 12 is a means 14 for selectively rejecting specific game related data. The means 14 for selectively rejecting specific game related data monitors data which is inputed into the control means 12. The control means 12 and the means 14 for selectively rejecting specific game related data are connected to various data input and display means 16, 32.

Figure 2:
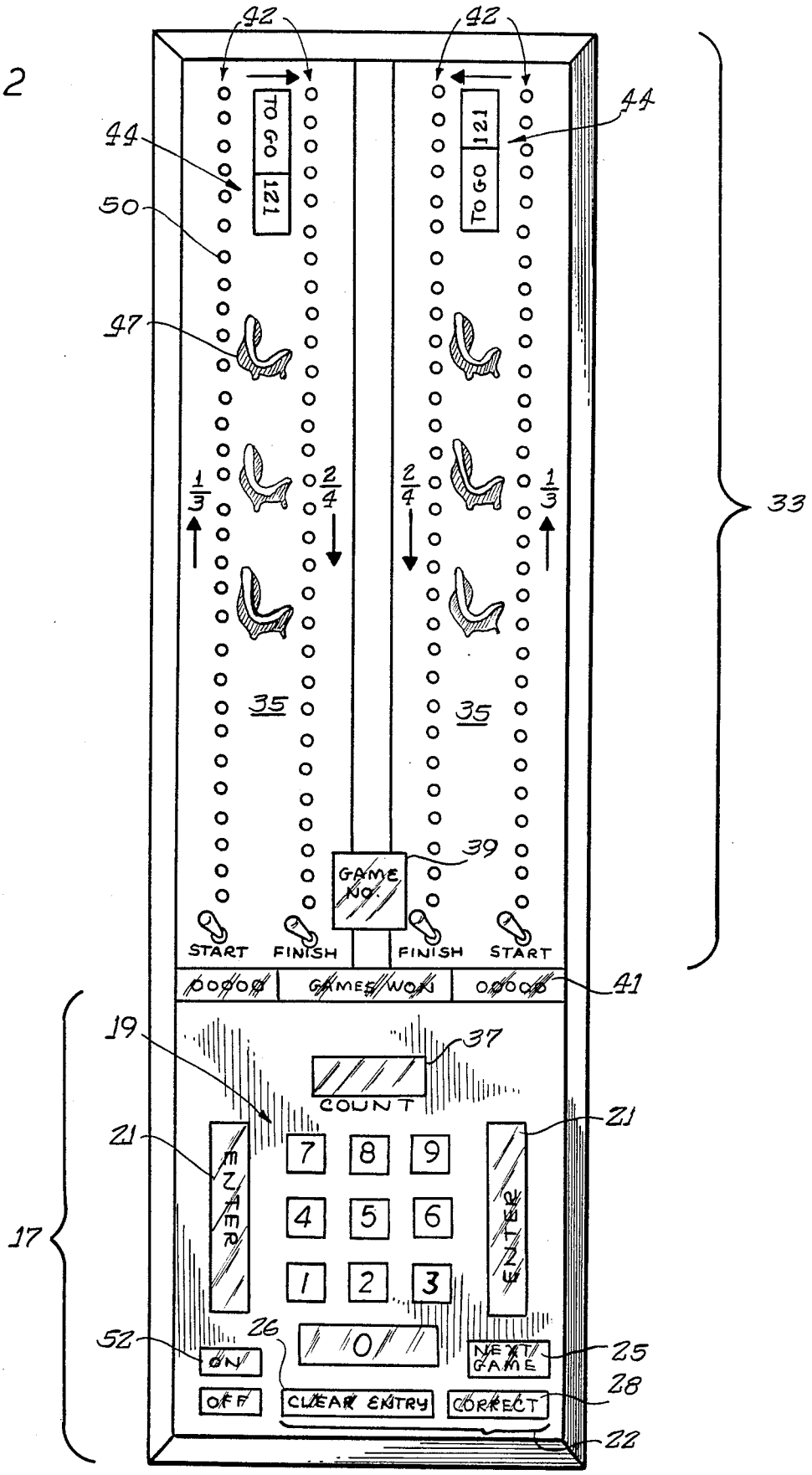
FIG. 2 is an illustration of a cribbage board configuration of the present invention.

The following description will be facilitated by reference to FIG. 1 and to FIG. 2 to more clearly describe the data input and display means 16, 32 shown in FIG. 1 by reference to the particular embodiment of these display means in the illustrated embodiment as shown in FIG. 2. In general, data input means 16 provide a means for inputting, verifying and deleting game related data with respect to the control means 12 as well as instructing the control means 12 that a new game has been selected. The data input means 16 include digital data input means 18, data verification means 20, data deletion means 22 and next game selecting means 24.

The data input means 16 are shown on FIG. 1 as transmitting data to the control means 12 over the respective data paths 10. As shown in FIG. 2, the data input means 16 comprise a series of buttons or "key pad" 17 shown generally in the lower section of the illustration of FIG. 2. The buttons used in the data input means 16 can be embodied in either three dimensional raised key pad buttons, membrane switch buttons, other pressure sensitive or photo electric input devices or any other means by which the user may cause discrete data to be entered. Additionally, the button arrangement shown in FIG. 2, while used in the illustrated embodiment, is not the only arrangement that can be used for the game of cribbage.

Digital input means 18 is represented by the 10-button single-digit data input buttons 19 numbered 0 through 9 as shown in the center of the data input means 16, the buttons 19 are configured in a general telephone or calculator touch pad arrangement to provide the most intuitive arrangement for discrete numerical entry. The digital data input means 18 is used to select numerical data for entry into the control means 12.

Data verification means 20 are represented on the data input means 16 of the illustration shown in FIG. 2 as "enter" (ENTER) buttons 21 located on the sides of the discrete data input means 18. The location of the enter buttons 21 allows each player to have a conveniently located data entry button 21 which may be pressed to verify that the data which has been selected using the digital data input means 18 is the correct number value or score which the player wishes to enter into the control means 12. The location of the enter buttons 21 is convenient and intuitive since traditionally a cribbage board is placed between the players as they play their cards.

Data deletion means 22 includes a "clear entry" function and a "correct" function represented in FIG. 2 by a clear entry button 26 (CLEAR ENTRY) and a correction (CORRECT) button 28, respectively. The clear entry button 26 eliminates the score which a player has input using the digital data input buttons 19 prior to entry into the control means 12 using the data verification means 20. The clear entry button 26 allows a player to clear a score and then input a new score and then to enter the score into the control means 12 using the data verification means 20. The data deletion means 22 operate to delete a score from the count presentation means 36 either before a player has entered the score using player data verification means 20 by using the clear entry key 26 or erase an already entered score from the graphic presentation means 34 and from control means 12 using the correct key 28 thus allowing a player to enter a new score. While the clear entry button 26 erases scoring errors for data that has not been entered into the control means 12, the correct button 28 retrieves an entered score and eliminates it from the control means. Further, the correct button 28 simultaneously decrements the previous score on the peg tracks 50 to reflect the corresponding player position prior to the erroneous entry. Once the score is appropriately recalled and removed the player may enter a new score using the discrete data input means 18 and verify this score using the data verification means 20 (enter button 21). Upon completion of a game, the players may choose to initiate a new game in a series or tournament by using next game selecting means 24, shown as a next game (NEXT GAME) button 25 in FIG. 2 which instructs the control means 12 to clear the pegs and other game specific data of the game just completed, and clear the peg tracks 50, reset the To Go windows 44 to one-to-one and to increment the game counting means 38 by one and clear the display in the game window 39 and increment the tally of the number of games won by each player in the games won window 41.

In response to input from the data input means 16, shown as the key pad 17 in FIG. 2, the control means 12 transmits the appropriate output data over output data paths 30 to data output means 32. The general data output means 32 includes graphic presentation means 34, score presentation means 36, game counting means 38 and game tally means 40. In the illustrated embodiment of the present invention shown in FIG. 2, these data output means 32 are represented by graphic display 35, score display 37, game counting display 39 and game tally display means 41, respectively. In the illustrated embodiment, liquid crystal displays (LCD's) are used for these output means.

For example, the graphic display 35 is capable of displaying cribbage track representations 42, peg routing symbols 44 and representational skunk symbols 47. Additionally, the graphic display 35 could incorporate the game counting display 39, game tally display 41 and score display 37; however, the illustrated embodiment shows these latter three elements as being independent from the graphic display 35. As will be further detailed in a discussion of FIG. 3, the graphic display 35 is actually made up of a liquid crystal display (LCD) element 48 driven by an LCD driver element 46.

The cribbage track representations 42 are a series of 31 peg position indicators 50 in two parallel rows for each player: a total of four rows. Located generally between the two cribbage track representations 42 of each player are the peg routing symbols 44. A "to go" (TO GO) portion of routing symbols 44 is silk screened or otherwise applied to the game surface and related numerals are displayed by the LCD. Since the "to go" symbol is not dynamic and does not change throughout the game, the symbol can be applied directly or on a protective sheet in this fashion. However, if desired, this portion of the graphic display means could also display various meaningful phrases as the player advances throughout the game relative to the players' position and the remaining number of peg position indicators 50 which each player must travel.

The representational skunk symbols 47 are shown generally located between two cribbage track representations 42 of each player. While skunk symbols 47 have been used in the illustrated embodiment a term other than skunk symbols, (for example "lurch"), could be used at this portion of the display. However, representational skunk symbols 47 are used in this illustrated embodiment of the present invention.

The game counting display 39 is shown positioned between the two players' cribbage track representations 42. An LCD is used to display the number of games which have been played since the previous activation of the next game selecting means 24 by pushing the next game button 25. Also, the game counting display means 39 shows the total plus one of the total games displayed on the game tally display 41. A difference of one game is found between the total number of the games won as displayed on the game tally display 41 and the number of games displayed on the game counting display 39 because the game which is in play cannot be counted as a win. For example, if each player has won two games and the players are engaged in a tie breaking game the game counting display 39 will display five and the game tally display 41 will display two indicators for each player. Additionally, the games won as displayed on the tally display 41 could be displayed as numerical representations instead of indicators as shown in FIG. 2. The score display 37 provides a numerical display of the numbers which are entered by a player using the digital data input buttons 19. Should the player input a score which is incapable of being achieved in the particular game in play, the means 14 for selectively rejecting specific game related data rejects the score and provides the player with feedback, such as a flashing score, a message, zeroing of the score or preventing the player from entering the score even though he has pressed the player data verification buttons 21.

Figure 3:
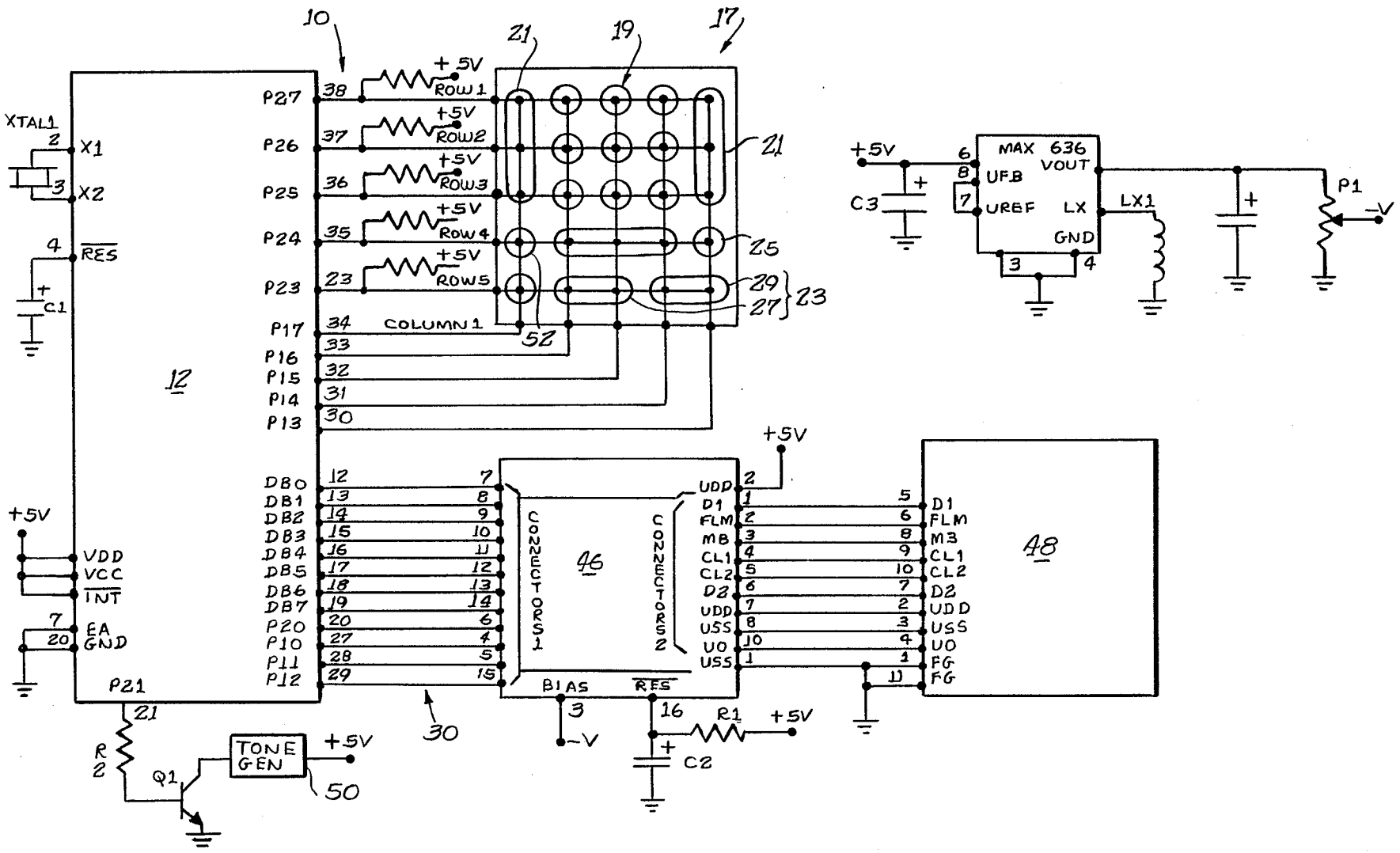
FIG. 3 is a circuit schematic of the present invention.

FIG. 3 provides a schematic diagram of the present invention. As shown in this schematic diagram, the key pad 17 is wired as an input matrix 50. This type of input matrix allows for flexibility in arranging the key pad which controls the input to the control means. While the present invention is arranged with the digital data input means 19 generally centralized on the key pad 17 with two player data verification buttons 21 on each side thereof and with data deletion buttons 26, 28 mounted below the digital data input buttons 19, this key pad could be configured for a different design, as desired. That is, keys regardless of the layout of the data input 17, the information to be transmitted to the control means 12 is transmitted over the same data input lines 10. Hence, only suitable reconfiguration or reprogramming of the control means (microprocessor) 12 is needed to accommodate a reconfigured key pad. Once received by the control means 12, the data is processed and then transmitted to the respective general data display means 33 over the data output lines 30. In this schematic the LCD 48 comprise the entire data display means 33, thereby incorporating graphic display 35, game counting display 39, game tally display 41 and score display 37.

Additionally, a tone generation means 50 is incorporated with the illustrated embodiment to provide audio output depending on the score of game being played.

Upon the proper set of circumstances, the control means 12 will direct the tone generation means 50 to produce one of a plurality of predetermined tones or chords based upon the score of the game being played. More specifically, when a player is "skunked" the control means will cause an appropriate number of skunk symbols 47 to be displayed on the graphic display means 35 and an appropriate audio accompaniment will be synchronously produced by the tone generation means 50. Otherwise the tone generation means may produce a suitable audio sound to verify actuation of the key pad, accompanying actuation of display elements, and the like.

In use, a player turns the game on by pressing a power switch 52 whereby the various data input means 16 and data output means 32 become enabled. Once the game is activated, the players play the game using the cards and the game rules for the game of cribbage while scoring using the cribbage board and game scoring device shown in FIG. 2. When a player needs to enter a score he first keys in the appropriate score using the digital data input means 19, which score is initially displayed on the score display or count window 37. If the displayed score is correct the player activates the player data verification means or "enter" button 21 thereby transmitting data over data lines 10 to the control means 12. The control means 12 processes the inputed data and the means 14 for selectively rejecting specific game related data determines whether this data is valid. Assuming that the means for selectively rejecting specific game related data 14 does not reject the introduction of the data into control means 12 the data is processed appropriately and appropriate corresponding displays are actuated. Should the player make an error when selecting or after entering his score using the digital data input means 19 he can correct his score using the data deletion means 22 by either using the clear entry button 26 to clear the entry before it has been entered using the player data verification means 21 or he may correct an already entered score using the correction key 28.

In the game of cribbage once the data is inputed into the control means 12, the appropriate game related symbols will be displayed on the graphic display means 35. In the present example, cribbage track representations 42, peg routing symbols 44 and representational skunk symbols 47 will be shown upon the reaching appropriate score or status of the game. Additionally, when a player loses by a specified score the control means 12 will automatically display an appropriate number of representational skunk symbols 47 and synchronously activate the tone generation means 50 to sound an appropriate accompaniment. As the game progresses, each player's wins are shown on the game tally display 41 and the number of games is displayed on the game counting display 39.

While particular embodiments of the present invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent after study. As such, the scope of the invention should not be limited by the particular embodiment and specific construction described herein, but should be defined in the depended claims and equivalents thereof. Accordingly, the aim of the appended claims is to cover all such changes and modifications as fall within the true spirit and scope of the invention.

The invention is claimed as follows:

1. An electronic cribbage board and game scoring device which is used to eliminate tedious and error-prone mental calculations and manual movement of pegs in scoring and recording games, said device comprising: microprocessor control means for receiving, processing and transmitting game related data; discrete data input means operatively coupled with said control means for inputting data to be entered into said control means; player data verification means operatively coupled with said control means for entering data inputted using said discrete data input means into said control means; data selection means operatively coupled with said control means for deleting game related data entries prior to and after entry to said control means; score presentation means responsive to data transmitted by said control means for displaying the score of the game being played based upon game related data entered into said control means by the players; games tally means responsive to data transmitted by said control means for receiving and displaying information pertinent to the status of the games won by each player; game counting means responsive to data transmitted by said control means for indicating the number of games which have been played, said game counting means being increased by an appropriate increment by said control means upon initiation of each new game; graphic presentation means responsive to data transmitted by said control means for displaying representational graphic images of symbols and characters corresponding to the status and score of the cribbage game being played, said symbols including cribbage tracks having a plurality of cribbage peg representation thereon; next game set up means operatively coupled with said control means and controllable by any player for directing said device to set up the device to initiate a new game including appropriate incrementing and resetting of tallying games won, incrementing games played, score presentation means and graphic presentation means, said device maintaining game scores and other pertinent game related data such that said control means receives game related data from said discrete input means, processes said received game-related data, and transmits said processed game-related data to said score presentation means, said game tally means, said game counting means and said graphic presentation means.

2. An electronic cribbage board and game scoring device according to claim 1 in which, said graphic presentation means is operatively coupled with said control means for displaying four cribbage tracks, and thirty cribbage peg representations along each of said four cribbage tracks indicating the respective positions of players based upon the respective score of each player as determined by said control means.

3. An electronic cribbage board and game scoring device according to claim 2 in which said graphic presentation means is operatively coupled with said control means for displaying other representational symbols based upon the status and score of the game as determined by said control means including skunk symbology and peg routing symbols indicating the respective player's peg position along at least one of said four cribbage tracks.

4. An electronic cribbage board and game scoring device according to claim 3 and further comprising tone generation means responsive to said control means for creating one of a plurality of predetermined tones or chords as determined by said control means based upon the status and score of the cribbage game being played said tone generating means producing a tone synchronous with the production of skunk symbology.

5. An electronic cribbage board and game scoring device according to claim 1 wherein data deletion means includes clear entry means for erasing a score from the count display prior to entry to said control means utilizing player data verification means, and correction means for permitting a player to correct scores erroneously entered into said control means by automatically recalling a score previously entered into said control means and decrementing the previous score to reflect the score prior to the erroneous entry thus allowing a player to input a new score using discrete data input means and enter the new score into the control means using the player data verification means.

6. An electronic cribbage board and game scoring device according to claim 1 wherein said control means further includes means for selectively rejecting specific game-related data based upon the score entered into the control means such that the scores of 19, 25, 26, 27 and greater than 29 are rejected by the control means and a new score is permitted to be input using discrete data input means and entered into the control means using player data verification means.

7. A electronic cribbage board and game scoring device which is used to eliminate tedious and error-prone mental calculations and manual manipulations in scoring and recording card games, said device comprising: control means for receiving, processing and transmitting game related data; discrete data input means operatively coupled with said control means for entering game related data into said control means; player data verification means operatively coupled with said control means for verifying data to be entered into said control means; data deletion means operatively coupled with said control means for deleting game related data entries prior to and after entry to said control means said data deletion means includes clear entry means for erasing a score prior to entry to said control means and correction means for permitting a player to correct scores erroneously entered into said control means by automatically recalling a score previously entered into said control means and decrementing the previous score to reflect the score prior to the erroneous entry; said control means including means for selectively rejecting specific game-related data based upon the score entered into the control means; score presentation means responsive to data transmitted by said control means for displaying the score of the game being played based upon game related data entered into said control means by the players; games tally means responsive to data transmitted by said control means for receiving and displaying information pertinent to the status of the games won by each player; game counting means responsive to data transmitted by said control means for indicating the number of games which have been played including the game currently being played, said game counting means being increased by an appropriate increment by said control means upon initiation of each new game; next game selecting means operatively coupled with said control means and controllable by any player for directing said device to initiate a new game; graphic presentation means responsive to data transmitted by said control means for displaying representational graphic images of symbols and characters corresponding to the score of the game being played, said symbols including cribbage tracks having a plurality of cribbage peg representations thereon; said device maintaining game scores and other pertinent game related data, such that said control means receives game related data from said discrete input means, processes said received game-related data, and transmits said processed game-related data to said score display means, said game tally means, said game counting means and said graphic presentation means.

* * * * *